US007721851B2

(12) United States Patent
Ducas et al.

(10) Patent No.: US 7,721,851 B2
(45) Date of Patent: May 25, 2010

(54) BOTTOM GUIDING DEVICE FOR ELEVATOR CAR AND LANDING DOORS

(75) Inventors: Philippe Ducas, Saint Firmin sur Loire (FR); Victor Carvalho, Gien (FR)

(73) Assignee: Otis Elevator Company, Farmington, CT (US)

( * ) Notice: Subject to any disclaimer, the term of this patent is extended or adjusted under 35 U.S.C. 154(b) by 758 days.

(21) Appl. No.: 11/578,312

(22) PCT Filed: May 5, 2004

(86) PCT No.: PCT/IB2004/001595

§ 371 (c)(1),
(2), (4) Date: Oct. 12, 2006

(87) PCT Pub. No.: WO2005/105654

PCT Pub. Date: Nov. 10, 2005

(65) Prior Publication Data

US 2007/0221456 A1 Sep. 27, 2007

(51) Int. Cl.
*B66B 13/06* (2006.01)
*E05D 13/00* (2006.01)

(52) U.S. Cl. ..... 187/334; 187/333; 49/411

(58) Field of Classification Search ..... 187/334, 187/333; 49/120, 366, 370, 411

See application file for complete search history.

(56) References Cited

U.S. PATENT DOCUMENTS 3,384,998 A * 5/1968 Abramson ..... 49/411

(Continued)

FOREIGN PATENT DOCUMENTS

DE 44 20 646 A1 12/1995

(Continued)

OTHER PUBLICATIONS

PCT International Preliminary Report on Patentability for PCT/IB2004/001595, dated Jul. 14, 2006.

*Primary Examiner*—John Q Nguyen
*Assistant Examiner*—Stefan Kruer

(57) ABSTRACT

The bottom guiding device according to the invention for telescoping elevator car and/or landing doors with at least one fast-moving door (3) and one slow-moving door (1) moving parallel to and within a small distance from a threshold plate (5) of a car and/or landing door respectively, is characterized in that it implements a threshold plate (5) on the car and/or landing side, formed with at least one lower edge parallel to the travel path of the doors (1, 3) and forming a bottom guide track (31) for the doors; a bottom plate (11) integral with the slower door (1) and extending with a small clearance below the faster door (3), provided on the threshold side with a guide track (13) parallel to the travel path of the doors (1, 3) and accommodating a guide element (19) integral with the faster door (3) and close to its rear lower end; at least two distant guide elements (25) integral with said bottom plate (11) on the slower door and accommodated on said (31) on the threshold plate so as to slide freely; and at least one guide element (33) integral with the faster door (3) and accommodated on said guide track (31) on the threshold plate, arranged substantially at the front end of the faster door (3) and sufficiently far from said guide elements (25) on the slow door (1) when the doors are opened and face each other.

7 Claims, 4 Drawing Sheets

U.S. PATENT DOCUMENTS 3,942,197 A * 3/1976 Sudmann et al. ..... 4/609
4,258,443 A * 3/1981 Baus ..... 4/557
4,458,449 A * 7/1984 Breuer ..... 49/411
4,781,270 A * 11/1988 Holland ..... 187/324
6,684,573 B2 * 2/2004 Heath et al. ..... 49/467
2003/0033754 A1 2/2003 Heath et al.

FOREIGN PATENT DOCUMENTS

DE 4420646 A1 * 12/1995
GB 2024902 A * 1/1980

* cited by examiner

BOTTOM GUIDING DEVICE FOR ELEVATOR CAR AND LANDING DOORS

FIELD OF THE INVENTION

This invention relates to a bottom guiding device for elevator car and landing doors.

DESCRIPTION OF THE RELATED ART

Elevator car and landing doors are known to be generally guided in their lower part by guide elements or shoes sliding in door threshold bar grooves. However, these grooves sometimes become filled with debris and prevent or block the free displacement of guide elements. In addition, these grooves are sometimes deformed on their upper edge, particularly if exposed to the passage of heavy loads. Lastly, these grooved threshold bars do not have a pleasant appearance on the floor.

Moreover, elevator doors opening in the middle and guided in their lower part by guide elements or shoes sliding below the threshold bar and on a lower guide edge thereof are also known. In this case, the sliding elements are protected from the deposition of debris and are invisible under the threshold bar.

U.S. patent application 2003/0033754 A also describes a bottom guiding device for telescoping elevator doors in which the faster-moving door is guided by at least two lower lateral guide legs sliding on a guide rail under the threshold plate and the slower-moving door is guided on one side together with the faster door and on the other side by a fixed point in the frame using a double bottom groove in the slower door. This guiding device has a disadvantage as far as guiding is concerned, since the front guiding point of the faster door comes up to the stationary rear guiding point in the double groove because the slower door is held in a point-shaped area and not rigidly on its length.

SUMMARY OF THE INVENTION

This invention aims at correcting this disadvantage and proposes a bottom guiding device for telescoping elevator car and/or landing doors, wherein at least one fast-moving door and one slow-moving door are displaced parallel to and within a small distance from, respectively, a car and/or a landing threshold plate, characterized in that it uses a threshold plate on the car and/or landing side formed with at least one lower edge parallel to the displacement path of the doors and forming a bottom guide track for the doors; a bottom plate integral with the slower door and extending under the faster door with a small clearance, provided on the threshold side with a guide track parallel to the displacement path of the doors and accommodating a guide element integral with the faster door and located near the rear lower end thereof; at least two guide elements remote and integral with said bottom plate of the slower door and accommodated to slide freely on said threshold plate tack, wherein they are approximately located at the lower end of the slower door; and at least one guide element integral with the faster door and accommodated on said threshold plate guide track, arranged approximately at the front end of the faster door and sufficiently far from said guide elements on the lower door as the doors open, when the doors are facing each other.

The result of this arrangement is that the slower door is guided relative to the corresponding threshold plate and the faster door is guided relative to the slower door for one of its lower sides common to both doors and relative to the threshold plate for its other front lower side. The slower door is held rigidly by two guiding points remote from the guide track in the threshold plate, and the faster door is also held rigidly in the transverse direction on its guiding ends by a guiding point on the track of the bottom plate of the slower door on one hand and by a guiding point on the guide track of the threshold plate on the other hand.

Said two remote guide elements on the slower door can be replaced by one guide element, provided it is long enough to ensure a rigid lengthwise guidance of the door.

The guide track on the bottom plate of the slower door obviously extends over a length that is at least equal to the displacement distance of the faster door.

In practice, since the slower and faster doors are equally wide, it extends over the length of the slower door from one edge to the other.

This track can be a regular straight profile of the bottom plate with a U-shaped cross-section and the corresponding guide element can be a pad or shoe substantially complementary to the profile cross-section and accommodated therein to slide with a small clearance.

Similarly, the guide track of the threshold plate is a regular straight profile with a downward U-shaped cross-section and the guide elements of the slower door and the faster door are pads or shoes with a cross-section substantially complementary to that of the profile and accommodated therein to slide with a small clearance.

In addition, this arrangement as per the invention provides the possibility to build a continuous floor on the car floor up to the threshold edge, and likewise on the landing, wherein the landing and car floors can be identical, with the same lining, which provides for a continuous-looking surface between the landing and the elevator car.

Finally, the invention also concerns elevators with car and/or landing doors equipped with a bottom guiding device as described above.

BRIEF DESCRIPTION OF THE DRAWINGS

The invention is illustrated hereafter on the basis of an exemplary embodiment, with reference to the appended drawings in which.

DETAILED DESCRIPTION

Figure 1:
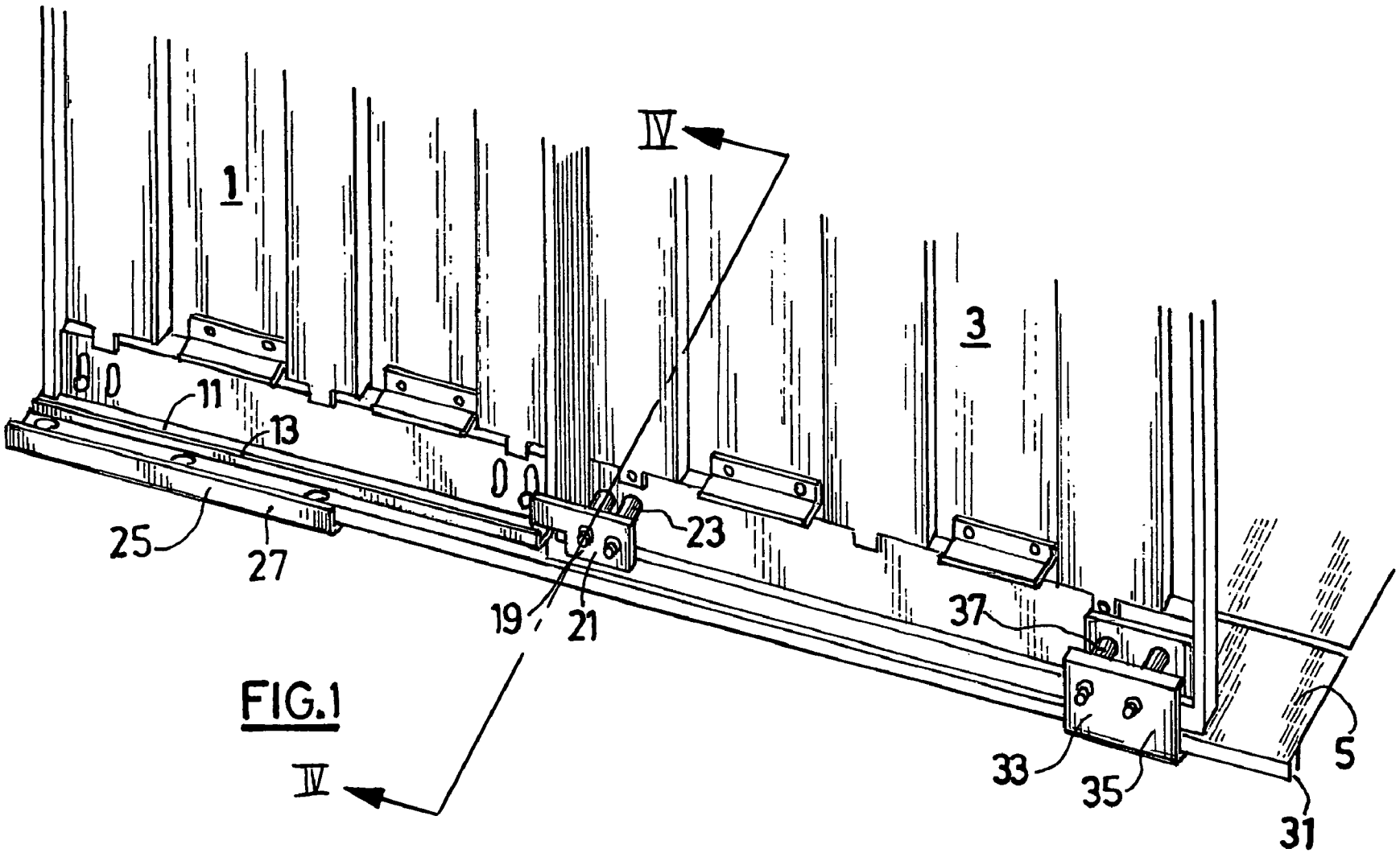
FIG. 1 is a perspective view showing a guiding device for telescoping elevator car doors according to the invention with the doors closed.

Referring to the drawings, the elevator door guiding device according to the invention concerns car doors and landing doors of the telescoping type comprising at least two telescoping panels sliding differentially relative to each other and overlapping each other. One of the panels or doors moves slowly and the other moves faster, wherein the displacement of the car and landing door panels is synchronized so that they open and close at the same time with regard to the opening of the landing door and of the car. The car and landing door panels have the same dimensions and thus open in front of each other on each side of the opening frame for the landing door and on each side of the car within a small distance from the car opening frame, and overlap each other partly as they close to shut off the landing opening and the car opening.

Figure 2:
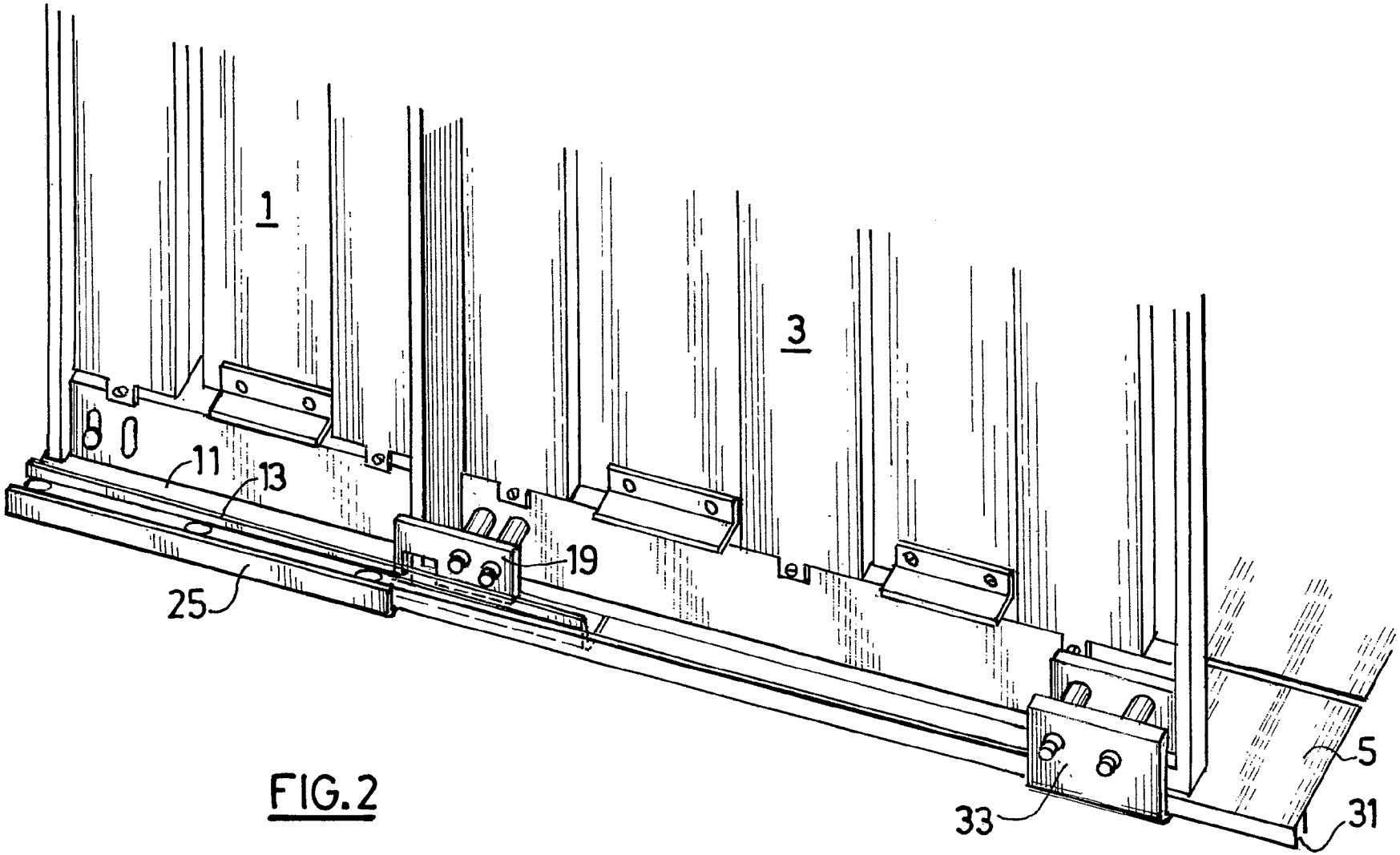
FIG. 2 is a view similar to FIG. 1 showing the device with half-opened doors.
Figure 3:
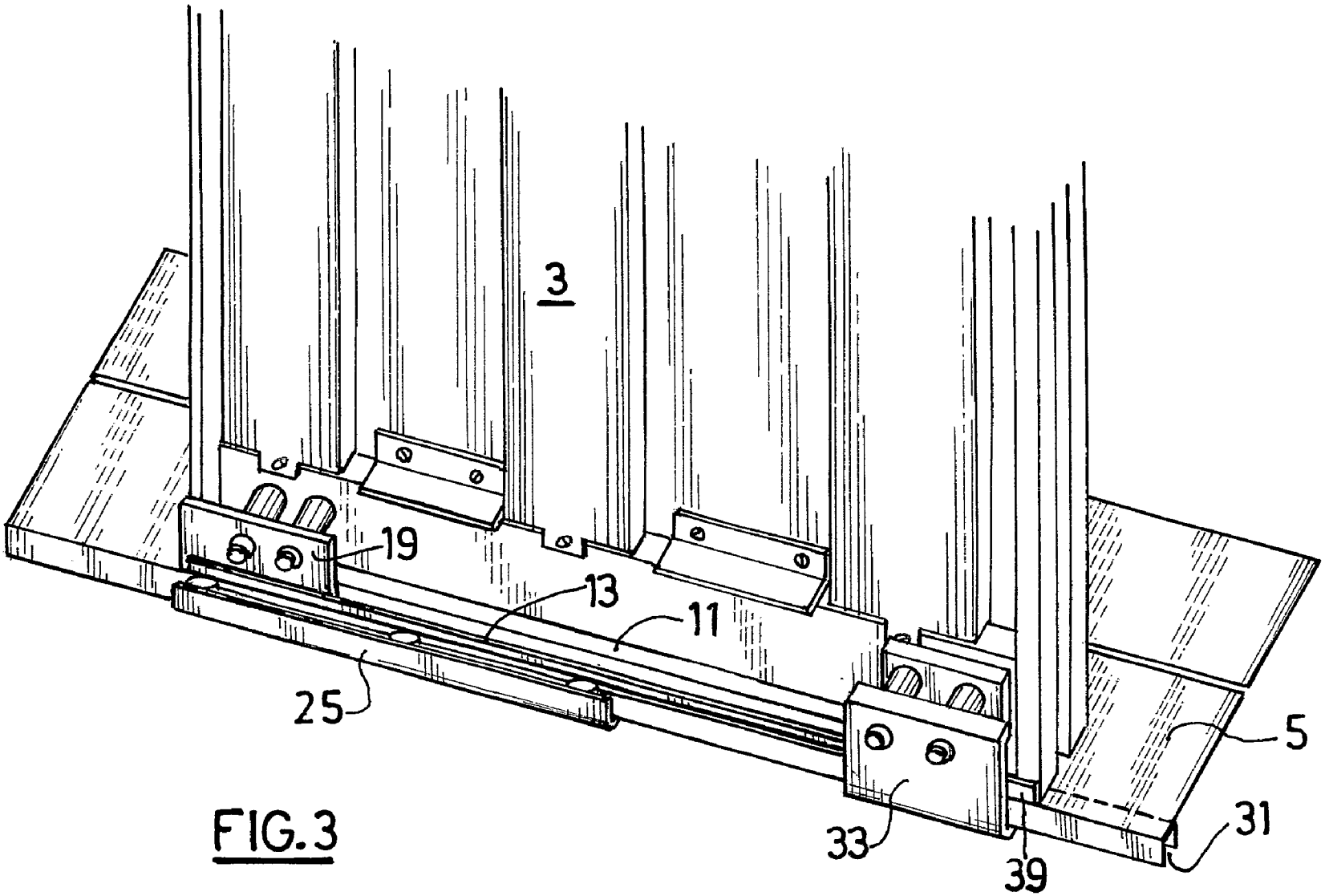
FIG. 3 shows the device with opened doors.

FIGS. 1 to 3 only show the lower part of the telescoping doors or door panels, and the following description is based on the guidance of car doors but also applies to landing doors in the same way.

The car door guiding device implements two telescoping elevator car doors, a slower door 1 and a faster door 3 having the same dimensions and overlapping each other to a variable extent during translation, as well as a threshold plate 5 integral with the car platform 7 and located on the edge of the car opening.

The doors 1, 3 slide to open or close the car opening represented by frame 9, within a small distance from and parallel to the threshold plate 5, which plate extends slightly beyond the traveling distance of the doors.

The doors 1, 3 are guided and driven in their upper part in a known manner by rolling off on a supporting rail (not represented) and guided in their lower part by the guiding device according to the invention, which is described below.

Figure 4:
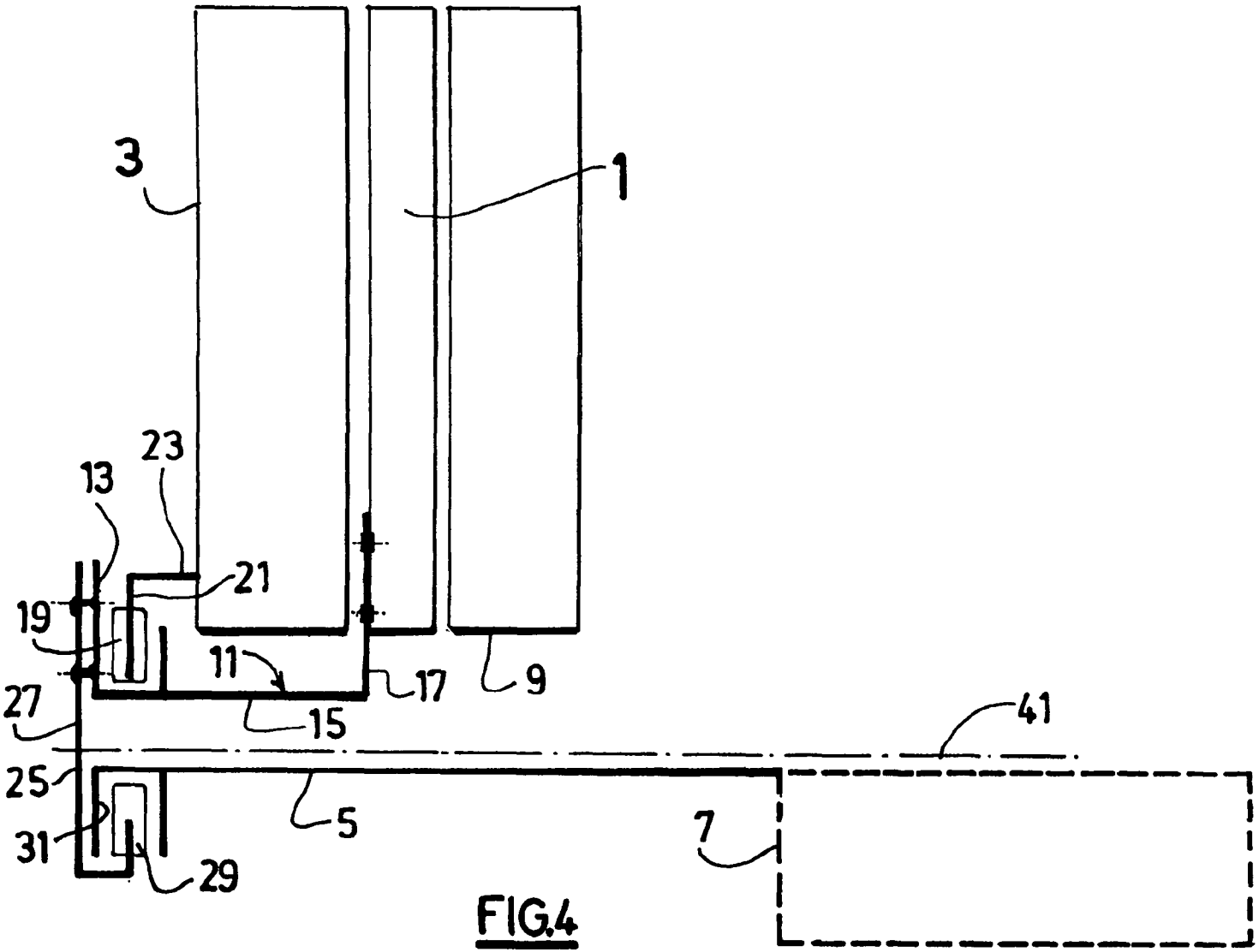
FIG. 4 is a cross-section of the device taken along line IV-IV shown in FIG. 1.

The device implements a bottom plate 11 integral with the slower door, which travels with a small clearance between the threshold plate 5 and the bottom end of the faster door 3 and comprises a regular guide profile 13 with a U-shaped section opened upwards on the threshold side of the car opening. This bottom plate 11 comprises a flat horizontal main part 15 extending across the breadth of the slower door and a vertical fold 17 by which it is attached to the front side of the slower door 1. The guiding profile 13 extends from one edge to the other across the breadth of the door 1 and parallel thereto and accommodates with a small clearance a shoe-shaped guide element 19 attached to the front lower part of the faster door 3 on the side of its rear end. This shoe element can be a rectangular felt block mounted to slide in said profile and guided longitudinally by the wings of the U-shaped profile 13. It is mounted on a vertical plate element 21 attached to the front side of the faster door by means of two supporting bridges 23, as shown best in FIG. 4.

A guide element 25 having a certain length is attached to the front wing of the above-mentioned profile 13 on the side of its rear end. This guide element is made of a plate element 27 (FIG. 4) folded back at its lower end, which end is provided with a shoe 29 accommodated in a complementary guide track 31 formed in the front end of the threshold plate 5. This guide track 31 is a regular profile with a U-shaped cross-section open downwards and accommodating said shoe 29 with a small sliding clearance. This track extends parallel to the translation path of the doors 1, 3 and is not externally visible. The shoe 29 can be a longitudinal-shaped element with a felt block having a certain length, e.g. as long as the width of the plate element 27, in order to allow a rigid guiding of the slower door relative to the track 31 of the threshold plate 5. It can also be made of two distant shoe elements mounted at each end of the plate element 27 (not represented).

A last guiding element 33 integral with the bottom guide track 31 of the threshold plate is attached to the lower end of the faster door 3 close to its front or outward end.

This guide element is made of a vertical plate 35 attached by two horizontal bridges 37 to the door and provided with a lower edge to which a shoe 39 is mounted, which shoe has a similar cross-section to the shoe 29 and is mounted into the track profile to slide with a small clearance. This guide element allows guiding the front lower end of the faster door, while its rear lower end is guided on the U-shaped track 13 integral with the slower door. Therefore the faster door 3 is guided partly relative to the slower door 1 and the guiding of each door is maintained along the length throughout the translation travel of the doors.

It should be noted that the guide element 27, 29 of the slower door and that 33 of the faster door must be complimentarily positioned in width so that they do not hit each other when the door open, as shown in FIG. 3.

Of course, as has already been mentioned, the car floor can be flat and continuous over its entire surface and provided with the same lining 41 extending over the threshold plate 5 and the rest of the car floor surface, as well as over the landing.

The invention claimed is:

1. Bottom guiding device for telescoping elevator car and/or landing doors with at least one fast-moving door and one slow-moving door moving parallel to and within a small distance from a threshold plate of a car and/or landing door respectively, the bottom guiding device comprising:

a threshold plate on a car and/or landing side, formed with at least one lower edge parallel to a travel path of the doors and forming a bottom first guide track for the doors;

a bottom plate integral with the slower door and extending with a clearance below the faster door, provided on a threshold side with a second guide track parallel to the travel path of the doors and accommodating a guide element integral with the faster door;

a guide element integral with said bottom plate on the slower door and accommodated on said first guide track on the threshold plate so as to slide freely; and a guide element integral with the faster door and accommodated on said first guide track on the threshold plate, arranged substantially at a front end of the faster door.

2. Guiding device as per claim 1, wherein the second guide track on the bottom plate of the slower door extends over a length that is at least equal to the traveling distance of the faster door.

3. Guiding device as per claim 2, wherein when the slower and faster doors have the same width, the second guide track extends over the width of the slower door from one edge to the other.

4. Elevator comprising telescoping car doors and/or landing doors equipped with a bottom guiding device as claimed in claim 1.

5. Guiding device as per claim 1, wherein the second guide track has a U-shaped cross-section in the bottom plate and the corresponding guide element is a pad or shoe element substantially complementary of the profile section and accommodated therein to slide.

6. Guiding device as per claim 1, wherein the first guide track of the threshold plate has a downward U-shaped cross-section and the guide elements of the slower door and that of the faster door are pad or shoe elements that have a cross-section substantially complementary of that of the profile and accommodated therein to slide.

7. Guiding device as per claim 1, further comprising a lining extending over the threshold plate and a car floor surface for a continuous-looking surface between the landing and the elevator car.

* * * * *